US005833239A

United States Patent [19]

Eleidjian

[11] Patent Number: 5,833,239

[45] Date of Patent: Nov. 10, 1998

[54] DUAL GAME UNIT

[76] Inventor: Anait Eleidjian, 16761 Viewpoint La., No. 397, Huntington Beach, Calif. 92647

[21] Appl. No.: 916,309

[22] Filed: Aug. 22, 1997

[51] Int. Cl.[6] ..... A63F 3/00

[52] U.S. Cl. ..... 273/248

[58] Field of Search ..... 273/248, 249, 273/243, 251, 252, 254

[56] References Cited

U.S. PATENT DOCUMENTS 2,970,840 2/1961 Richie ..... 273/254 X 4,087,094 5/1978 Bakay ..... 273/254

5,002,283 3/1991 Langham et al. ..... 273/252

5,135,231 8/1992 Piper ..... 273/254

*Primary Examiner*—William E. Stoll

[57] ABSTRACT

A dual game unit is provided including a game mechanism having a front face and a rear face. The front face has a square matrix of boxes situated thereon. The boxes include an arrow situated therein and pointing toward an adjacent box. Next provided is a first random selection mechanism for randomly picking a unique number. The rear face has a plurality of circles situated therein to define a pyramid with an apex. Each circle has a unique color printed therein. Also included is a second random selection mechanism for randomly picking a unique color.

10 Claims, 3 Drawing Sheets

DUAL GAME UNIT

BACKGROUND OF THE INVENTION

1. Field of the Invention

The present invention relates to a dual game unit and more particularly pertains to providing an educational game with two associated methods of play.

2. Description of the Prior Art

The use of educational games is known in the prior art. More specifically, educational games heretofore devised and utilized for the purpose of providing entertainment and for educational purposes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,156,409 to Barnes; U.S. Pat. No. 4,185,819 to Hartley; U.S. Pat. Des. 343,644 to Boss et al.; U.S. Pat. No. 5,248,152 to Timmerman; U.S. Pat. No. 4,445,690 to Cairns; and U.S. Pat. No. 3,515,385 to Gunderson.

In this respect, the dual game unit according to the present invention substantially departs from the conventional concepts and designs of the prior art, and in so doing provides an apparatus primarily developed for the purpose of providing an educational game with two associated methods of play.

Therefore, it can be appreciated that there exists a continuing need for a new and improved dual game unit which can be used for providing an educational game with two associated methods of play. In this regard, the present invention substantially fulfills this need.

SUMMARY OF THE INVENTION

In view of the foregoing disadvantages inherent in the known types of educational games now present in the prior art, the present invention provides an improved dual game unit. As such, the general purpose of the present invention, which will be described subsequently in greater detail, is to provide a new and improved dual game unit which has all the advantages of the prior art and none of the disadvantages.

To attain this, the present invention essentially comprises a game unit having a rectangular configuration with a front face, a rear face, a top face, a bottom face, and a pair of side faces formed therebetween defining an interior space. As shown in FIG. 1, the front face of the game unit has a square matrix of boxes situated thereon. The boxes include a start box positioned adjacent the bottom face and one of the side faces of the game unit. Further included is a finish box positioned adjacent the top face of the game unit directly above the start box. Each remaining box has an arrow situated therein which points toward one of four adjacent boxes. With further reference to FIG. 1, a disk shaped number wheel is provided with a first circular face thereof rotatably coupled to one of the side faces of the game unit adjacent the bottom face thereof. A periphery of the disk shaped number wheel has a plurality of sections with a number positioned therein. As shown in FIG. 2, a rear face of the game unit has a plurality of circles situated therein to define a pyramid. An apex of such pyramid is centrally positioned adjacent the top face of the game unit. Each circle has a unique color printed therein. Next provided is a disk shaped color wheel with a first circular face thereof rotatably coupled to one of the side faces of the game unit. The side face to which the color wheel is attached is opposite to that which the number wheel is attached and is further in coaxially alignment therewith. The color wheel has a plurality of sections with a unique color positioned therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dual game unit which has all the advantages of the prior art educational games and none of the disadvantages.

It is another object of the present invention to provide a new and improved dual game unit which may be easily and efficiently manufactured and marketed.

It is a further object of the present invention to provide a new and improved dual game unit which is of a durable and reliable construction.

An even further object of the present invention is to provide a new and improved dual game unit which is susceptible of a low cost of manufacture with regard to both materials and labor, and which accordingly is then susceptible of low prices of sale to the consuming public, thereby making such dual game unit economically available to the buying public.

Still yet another object of the present invention is to provide a new and improved dual game unit which provides in the apparatuses and methods of the prior art some of the advantages thereof, while simultaneously overcoming some of the disadvantages normally associated therewith.

Still another object of the present invention is to provide an educational game with two associated methods of play.

Lastly, it is an object of the present invention to provide a new and improved dual game unit is provided including a game mechanism having a front face and a rear face. The front face has a square matrix of boxes situated thereon. The boxes each include an arrow situated therein and pointing toward one of four adjacent boxes. Next provided is a first random selection mechanism for randomly picking a unique number. The rear face has a plurality of circles situated therein to define a pyramid with an apex. Each circle has a unique color printed therein. Also included is a second random selection mechanism for randomly picking a unique color.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
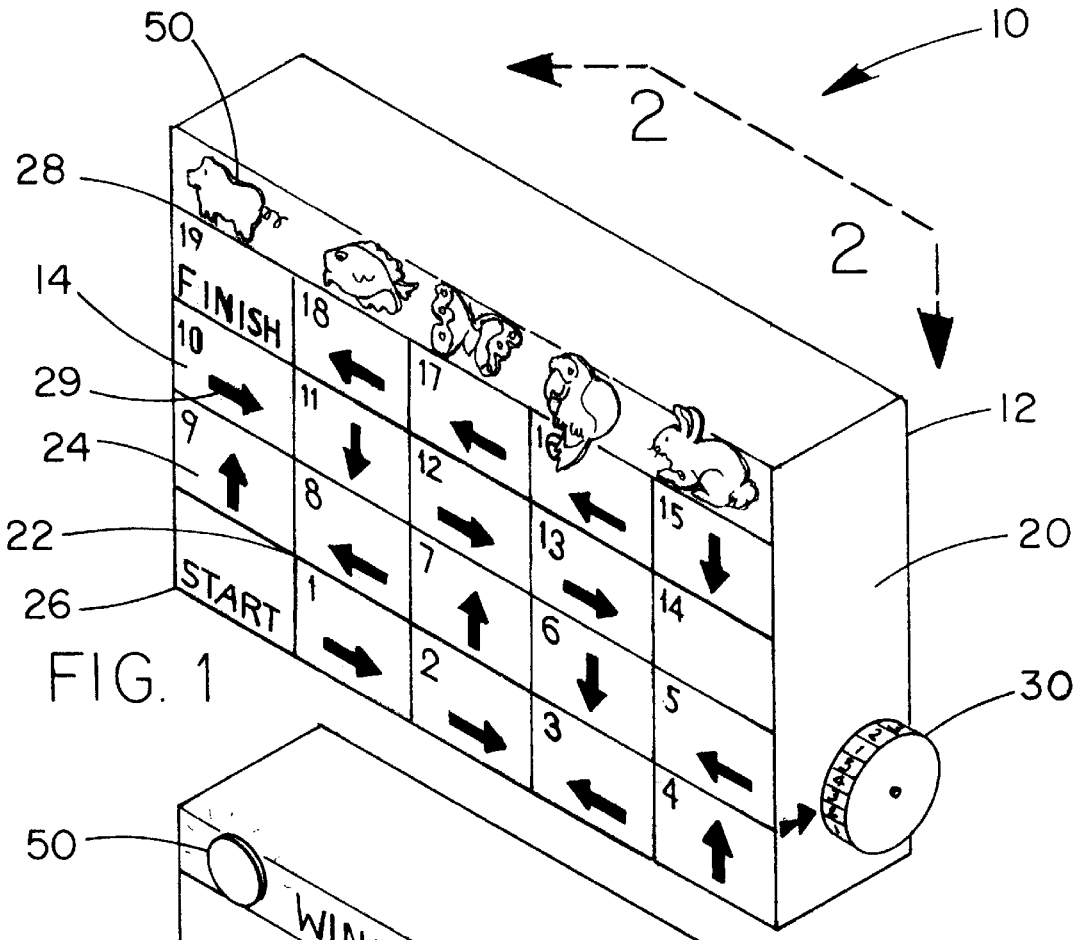
FIG. 1 is a perspective illustration of the preferred embodiment of the dual game unit constructed in accordance with the principles of the present invention.

With reference now to the drawings, and in particular to FIG. 1 thereof, a new and improved dual game unit embodying the principles and concepts of the present invention and generally designated by the reference numeral 10 will be described.

The present invention, the new and improved dual game unit, is comprised of a plurality of components. Such components in their broadest context include a game unit, a color wheel and a number wheel. Such components are individually configured and correlated with respect to each other so as to attain the desired objective.

More specifically, it will be noted that the system 10 of the present invention includes a game unit 12 having a rectangular configuration with a front face 14, a rear face 16, a top face, a bottom face, and a pair of side faces 20 formed therebetween defining an interior space. Preferably, the top face is open thereby allowing the use of the interior space for storing various items. In the alternative, the top face may be closed to allow the use thereof as a shelf. As shown in FIG. 1, the front face of the game unit has a square matrix 22 of boxes 24 situated thereon. The boxes include a start box 26 positioned adjacent the bottom face and one of the side faces of the game unit. Further included is a finish box 28 positioned adjacent the top face of the game unit directly above the start box. Each remaining box has an arrow 29 situated therein which points toward one of four adjacent boxes. Such arrows define a plurality of paths each of which lead from the start box to the finish box.

With further reference to FIG. 1, a disk shaped number wheel 30 is provided with a first circular face thereof rotatably coupled to one of the side faces of the game unit adjacent the bottom face thereof. An outer periphery of the disk shaped number wheel has a plurality of sections each with a number positioned therein.

Figure 2:
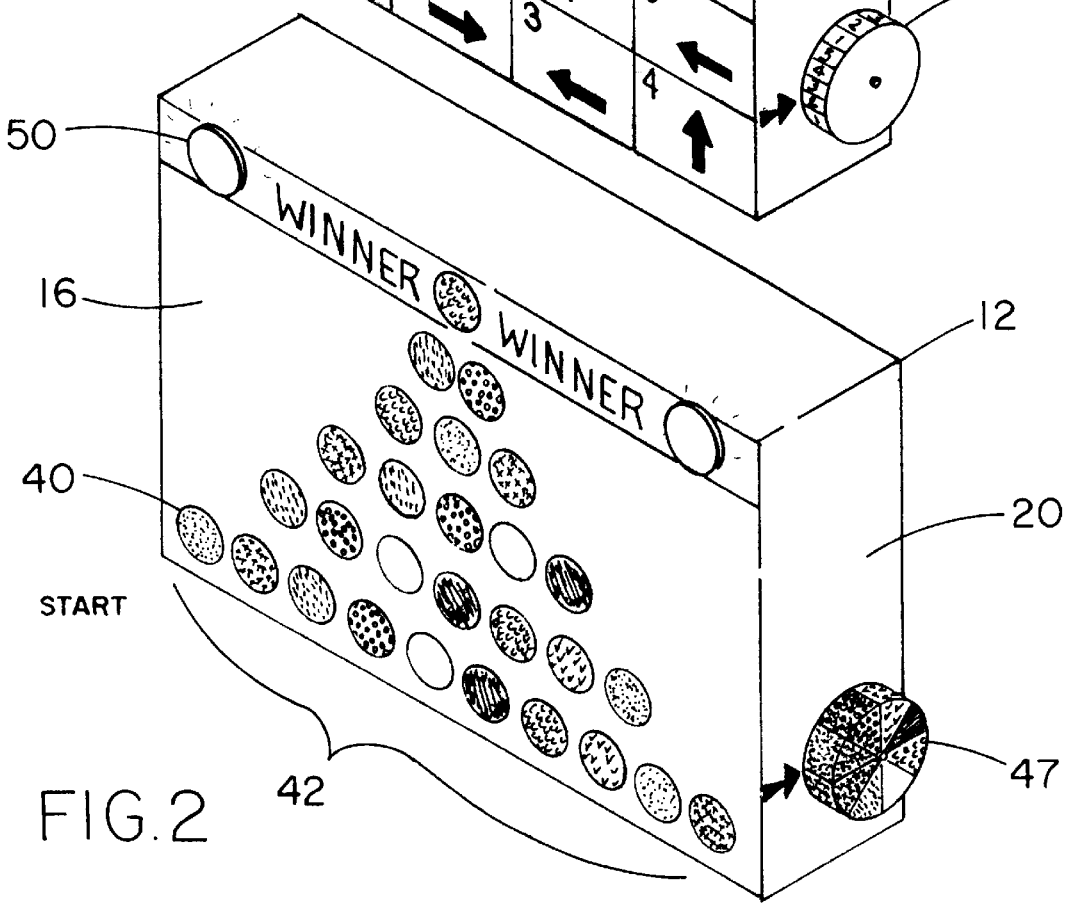
FIG. 2 is a rear perspective view of the game unit shown in FIG. 1.
Figure 3:
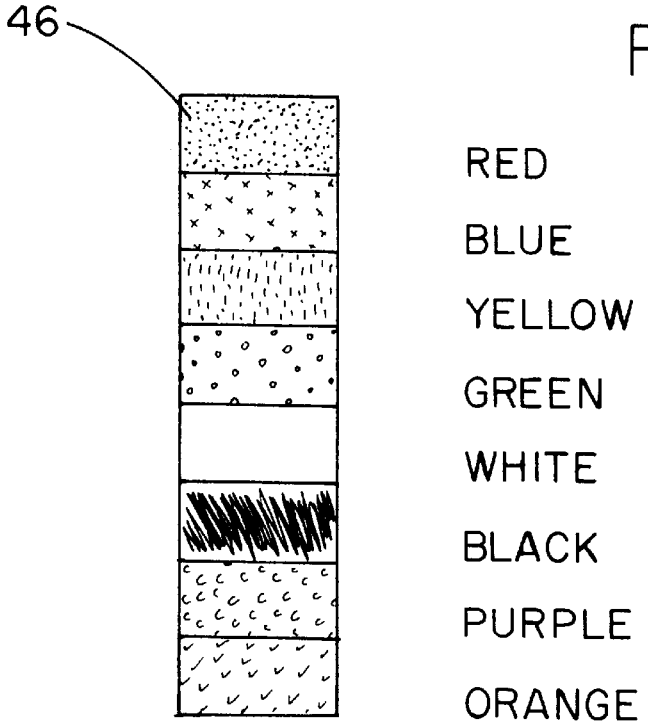
FIG. 3 is an illustration of the colors of the pyramid of the rear face of the game unit.

As shown in FIG. 2, the rear face of the game unit has a plurality of circles 40 situated therein to define a pyramid 42. An apex 44 of such pyramid is centrally positioned adjacent the top face of the game unit. Each circle has a unique color 46 printed therein which is different from that of an adjacent color.

Next provided is a disk shaped color wheel 47 with a first circular face thereof rotatably coupled to one of the side faces of the game unit. The side face to which the color wheel is attached is opposite to that which the number wheel is attached and is further in coaxially alignment therewith. The color wheel has a plurality of pie-shaped sections each with a unique color positioned therein.

Finally, it should be noted that tokens 50 may be included to track movement on the game unit. Such tokens may be formed of a magnetic material to releasably coupled to the game unit which would be metal. This allows use of the game unit in a vertical orientation.

The method associated with the present invention will now be set forth. Play begins by choosing at least one of the front face and rear face of the game unit to play from. A first game is played if the front face is chosen. Such game allows each of a plurality of players to take a turn. During each turn, the player spins the number wheel thereby selecting a number. Such number is selected by means of an arrow printed on the side face of the game unit. Next, the user moves a token thereof from a present box to a next box only along the paths dictated by the arrows. The number of boxes traversed must be equal to the number selected. Further, it is imperative that while traversing each box, the arrow printed thereon only dictates the direction of movement to an adjacent box. It should be further noted that movement is started at the start box and a winner is declared as a player who first lands on the finish box. If the rear face is chosen, a second game is played wherein each of a plurality of players are to alternate taking turns, similar to the first game. First, the current player spins the color wheel thereby selecting a color. Next, a token is moved from a present circle to a circle with a color that matches the selected color. Such movement is started at a bottommost circle of the pyramid. Further, the circle where the token is moved must be the circle closest to the original circle which bears the selected color. Finally, a winner of the second game is declared as a player who first lands on a circle located at the apex of the circle.

Figure 4:
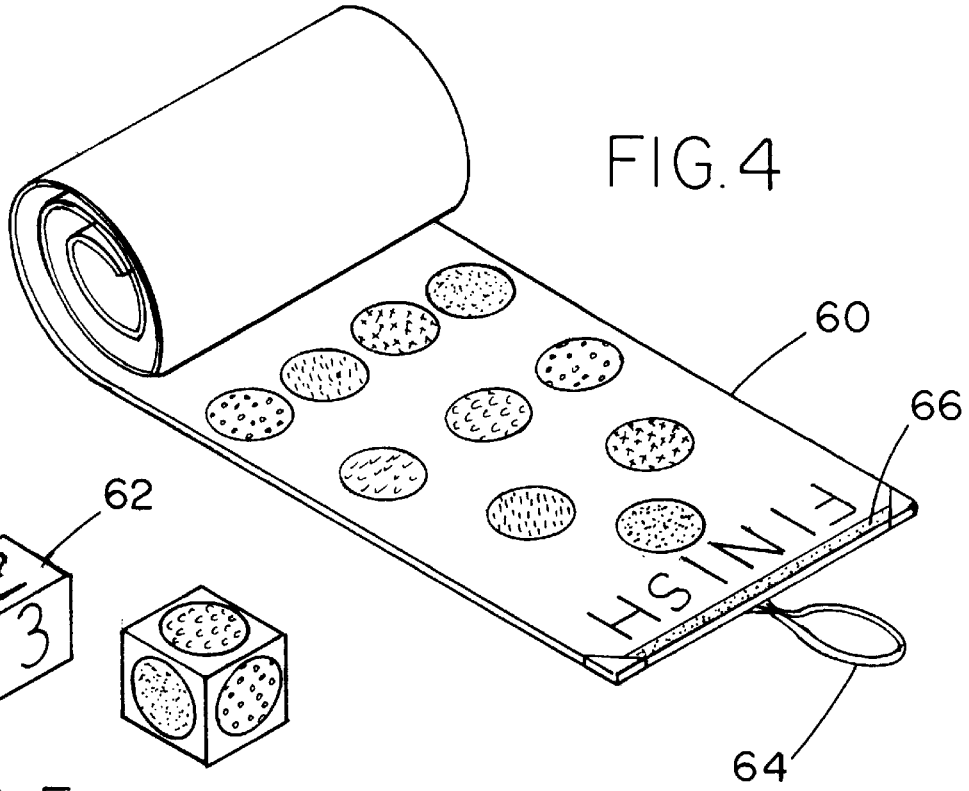
FIG. 4 is a perspective view of an alternate embodiment of the present invention.

In an alternate embodiment shown in FIG. 4, a flexible mat 60 is provided in lieu of a game unit and further has a front and rear face similar to that of the first embodiment. Instead of wheels, a pair of dice 62 are included. A first die has a plurality of colors printed thereon. A second die has a plurality of numbers printed thereon. To facilitate totting of the mat, a carry strap 64 is coupled to an edge of the mat. Further, the edge of the mat is equipped with a VELCRO strap 66 which is releasably coupled with a face of the mat. By such structure, the mat may be conveniently stored. Further, it should be understood that the players constitute tokens and accordingly, the mat has a length of no less than 4 feet. As an option, the dice and wheels of the previous embodiments may be interchanged or replaced by an electronic random selection means.

Figure 5:
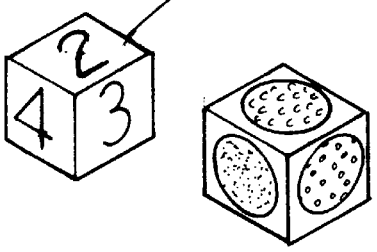
FIG. 5 is a perspective view of the dice associated with the alternate embodiment of the present invention.
Figure 6:
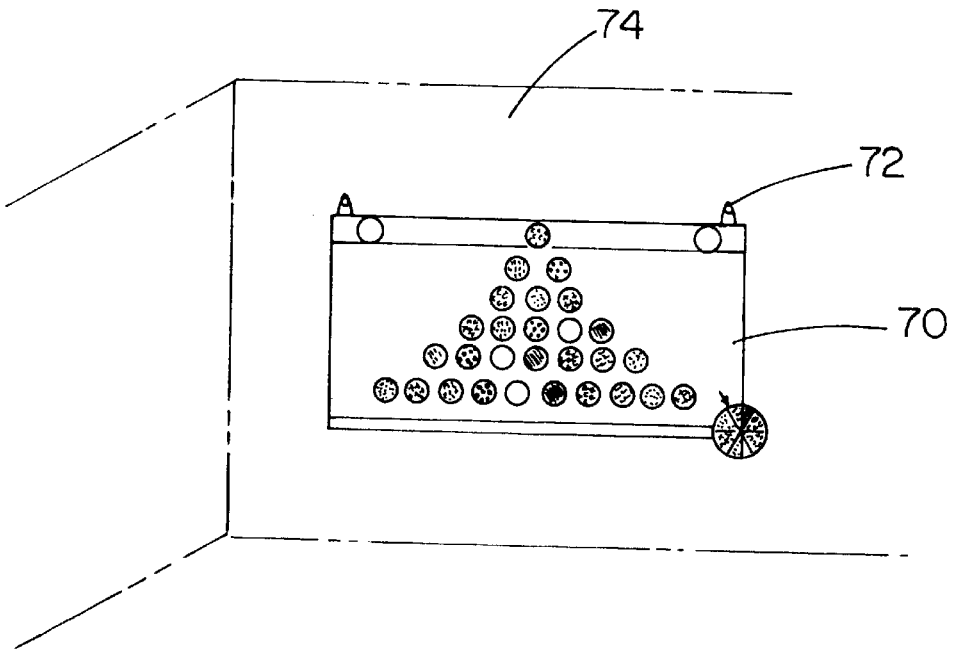
FIG. 6 is an illustration of yet another alternate embodiment of the present invention.
Figure 7:
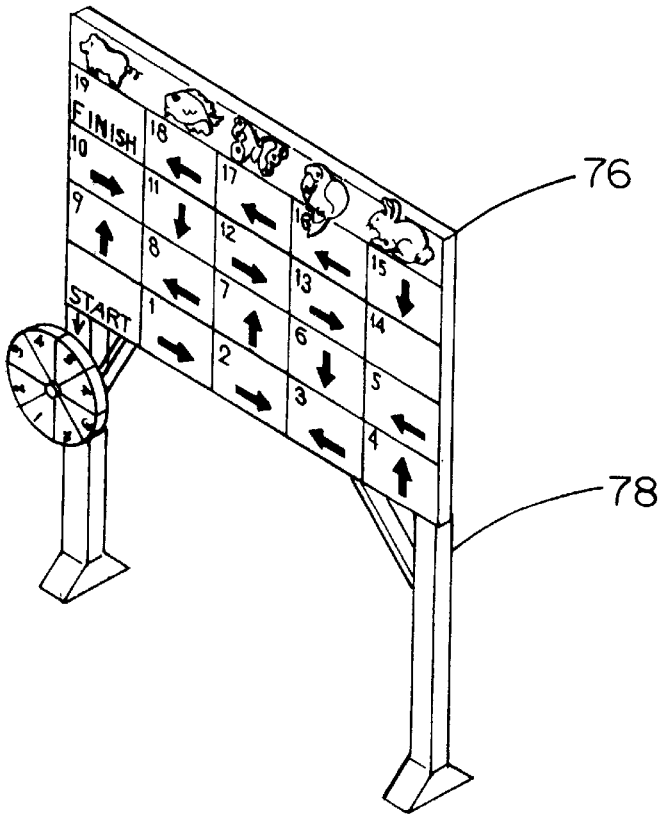
FIG. 7 is a perspective view of still yet another alternate embodiment of the present invention.

In yet another alternate embodiment shown in FIG. 5, a poster 70 is provided in lieu of the mat or game unit. In such embodiment, the spinning wheel is mounted on a lower corner thereof. A pair of closed loops 72 are coupled to a top edge of the poster for allowing the mounting of the poster on a vertical recipient surface 74 such as a wall. Still yet another alternate embodiment is shown in FIG. 6. Such embodiment includes a vertically oriented rigid board 76 which is supported by a pair of legs 78. In the present embodiment, the spinning wheel is mounted adjacent a lower corner of the rigid board.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved dual game unit comprising, in combination:

a game unit having a rectangular configuration with a front face, a rear face, a top face, a bottom face, and a pair of side faces formed therebetween defining an interior space;

said front face having a matrix of boxes situated thereon, the boxes including a start box positioned adjacent the bottom face and one of the side faces of the game unit, a finish box positioned adjacent the top face of the game unit directly above the start box, a plurality of the boxes having an arrow situated therein and pointing toward one of a plurality of adjacent boxes;

a disk shaped number wheel with a first circular face thereof rotatably coupled to one of the side faces of the game unit adjacent the bottom face thereof and a periphery having a plurality of sections with a number positioned therein;

said rear face having a plurality of circles situated therein to define a pyramid with an apex centrally positioned adjacent the top face of the game unit, each circle having a unique color printed therein; and a disk shaped color wheel with a first circular face thereof rotatably coupled to one of the side faces of the game unit opposite the number wheel in coaxially alignment therewith and adjacent the bottom face of the game unit, the color wheel having a plurality of sections with a unique color positioned therein.

2. A dual game unit comprising:

a game means having a front face and a rear face;

said front face having a matrix of boxes situated thereon, a plurality of the boxes including an arrow situated therein and pointing toward an adjacent box;

a first random selection means for randomly picking a unique numbers;

said rear face having a plurality of circles situated therein to define a pyramid with an apex, each circle having a unique color printed therein; and a second random selection means for randomly picking a unique color.

3. A dual game unit as set forth in claim 2 wherein the first and second random selection means each include a disk shaped number wheel.

4. A dual game unit as set forth in claim 2 wherein the first and second random selection means comprises a pair of dice.

5. A dual game unit as set forth in claim 2 wherein the first and second random selection means are formed of electronic components.

6. A dual game unit as set forth in claim 2 wherein the game means is a box with a rectangular configuration.

7. A dual game unit as set forth in claim 2 wherein the game means is a flexible flat mat.

8. A dual game unit as set forth in claim 2 wherein the game means is a poster.

9. A dual game unit as set forth in claim 2 wherein the game means is a vertically oriented board mounted on a pair of legs.

10. A method of playing a game comprising the steps of:

providing a game unit having a rectangular configuration with a front face, a rear face, a top face, a bottom face, and a pair of side faces formed therebetween defining an interior space;

providing said front face having a matrix of boxes situated thereon, the boxes including a start box positioned adjacent the bottom face and one of the side faces of the game unit, a finish box positioned adjacent the top face of the game unit directly above the start box, a plurality of the boxes having an arrow situated therein and pointing toward one of a plurality of adjacent boxes;

providing a disk shaped number wheel with a first circular face thereof rotatably coupled to one of the side faces of the game unit adjacent the bottom face thereof and a periphery having a plurality of sections with a number positioned therein;

providing said rear face having a plurality of circles situated therein to define a pyramid with an apex centrally positioned adjacent the top face of the game unit, each circle having a unique color printed therein;

providing a disk shaped color wheel with a first circular face thereof rotatably coupled to one of the side faces of the game unit opposite the number wheel in coaxially alignment therewith and adjacent the bottom face of the game unit, the color wheel having a plurality of sections with a unique color positioned therein;

choosing at least one of the front face and rear face of the game unit to play from;

playing a first game if the front face is chosen, said first game allowing each of a plurality of players to take a turn with each turn comprising the steps of:

spinning the number wheel thereby selecting a number, moving a token from box to box only in the direction of the arrows a number of boxes equal to the number selected, whereby movement is started at the start box, and declaring a winner as a player who first lands on the finish box; and playing a second game if the second face is chosen, said second game allowing each of a plurality of players to take a turn with each turn comprising the steps of:

spinning the color wheel thereby selecting a color, moving a token from a present circle to a circle with a color that matches the selected color, whereby movement is started at a bottommost circle of the pyramid, and declaring a winner as a player who first lands on a circle located at the apex of the pyramid.

* * * * *